US007329153B2

(12) United States Patent
Lin et al.

(10) Patent No.: US 7,329,153 B2
(45) Date of Patent: Feb. 12, 2008

(54) AUDIO OUTPUT DEVICE

(75) Inventors: Chia-Huang Lin, Tucheng (TW); Yan Rao, Kunshan (CN); Hai-Ju Sun, Kunshan (CN); Wei Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/446,691

(22) Filed: Jun. 5, 2006

(65) Prior Publication Data

US 2006/0276062 A1 Dec. 7, 2006

(30) Foreign Application Priority Data

Jun. 7, 2005 (CN) ..... 2005 2 0072489 U

(51) Int. Cl.
*H01R 24/00* (2006.01)

(52) U.S. Cl. ..... 439/660; 439/939

(58) Field of Classification Search ..... 439/660, 439/939

See application file for complete search history.

(56) References Cited

U.S. PATENT DOCUMENTS 6,165,016 A * 12/2000 Lai ..... 439/610
6,364,699 B1 * 4/2002 Hwang et al. ..... 439/555
6,707,924 B1 * 3/2004 Okiebisu ..... 381/385
7,070,425 B2 * 7/2006 Regen et al. ..... 439/131
7,097,472 B2 * 8/2006 Parker ..... 439/131
7,128,617 B2 * 10/2006 Wang et al. ..... 439/660
2001/0052421 A1 * 12/2001 Liao ..... 174/135
2004/0199687 A1 * 10/2004 Hsu et al. ..... 710/74
2005/0052852 A1 * 3/2005 Ono ..... 361/749
2005/0058306 A1 * 3/2005 Peng ..... 381/118
2005/0148313 A1 * 7/2005 Chee ..... 455/347
2005/0186850 A1 * 8/2005 Tsai ..... 439/660
2005/0219843 A1 * 10/2005 Arell et al. ..... 362/253
2006/0155914 A1 * 7/2006 Jobs et al. ..... 711/100
2006/0214511 A1 * 9/2006 Dayan ..... 307/38
2006/0267994 A1 * 11/2006 Pfleging et al. ..... 345/530
2007/0050911 A1 * 3/2007 Elsener ..... 7/118
2007/0053523 A1 * 3/2007 Iuliis et al. ..... 381/77

FOREIGN PATENT DOCUMENTS

JP 2000071094 * 9/2000
JP 2001-258078 * 9/2001

* cited by examiner

*Primary Examiner*—Briggitte R. Hammond
*Assistant Examiner*—Larisa Tsukerman
(74) *Attorney, Agent, or Firm*—Wei Te Chung

(57) ABSTRACT

An audio output device (200) adapted for matching with a MP 3 player (100), comprises a cap (20) and an earphone assembly (30) connecting with the cap (20). The cap (20) has a body (21) and a connector (22) received in the body (21). The connector (22) includes a housing (222), a number of terminals (223, 224) receiving in the housing (222) and a shielding member (221) enclosing the housing (222). The connector (22) is capable of matching with a plug according with the standard of USB (Universal Serial Bus), the terminals (223, 224) include three audio terminals transmitting audio signal. The earphone assembly (30) includes two strings (32) connecting with the three audio terminals and a pair of headphones (33) setting on the other end of the strings (32).

13 Claims, 8 Drawing Sheets

AUDIO OUTPUT DEVICE

BACKGROUND OF THE INVENTION

1. Field of the Invention

The present invention relates to an audio output device, and particularly to an audio output device adapted for matching with consuming electronics.

2. Description of the Prior Art

With the rapid widespread use of the INTERNET, MP 3 (MPEG-1 Audio Layer-3) becomes the most prevalent music format. Basically, the main advantage is the size of audio files compressed in MP 3 format. There aren't many other formats currently available that can reduce file sizes to the same extent as MP3 while keeping fairly good sound quality. Secondly, MP3 files are downloadable directly from the website. Accordingly, the MP 3 player is widely prevalent among the youngster because of its small size, good quality, and multi-functions. Usually, the MP 3 player includes an audio jack mating with an earphone and a data-transmitting port according to USB (Universal Serial Bus) standard connecting with a complementary connector of a computer.

As a standard input/output port, USB port is widely used in many kinds of electrical devices. A USB connector commonly comprises an insulative housing defining a tongue board and a plurality of terminals. A number of receiving passageways defined in the insulative housing extend to the tongue board, and the terminals lie in the receiving passageways.

To meet with more demands, for instance, two lovers will share the same MP 3 player in some instance. Accordingly, an additional audio jack is required on the basis of the present MP 3 player, thus, the additional audio jack will increase the size of the MP 3 player and complex the structure of the MP 3 player which goes against the trend of miniaturization. Hence, an improved audio device is desired to overcome the disadvantages mentioned-above.

BRIEF SUMMARY OF THE INVENTION

Therefore, a main object of the present invention is to provide an audio output device achieving the function of transmitting audio signals through USB port.

To fulfill the above-mentioned object, audio output device adapted for matching with a MP 3 player, comprises a cap and an earphone assembly connecting with the cap. The cap has a body and a connector received in the body. The connector includes a housing, a number of terminals receiving in the housing and a shielding member enclosing the housing. The connector is capable of matching with a plug according with the standard of USB (Universal Serial Bus), the terminals include three audio terminals transmitting audio signal. The earphone assembly includes two strings connecting with the three audio terminals and a pair of headphones setting on the other end of the strings.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
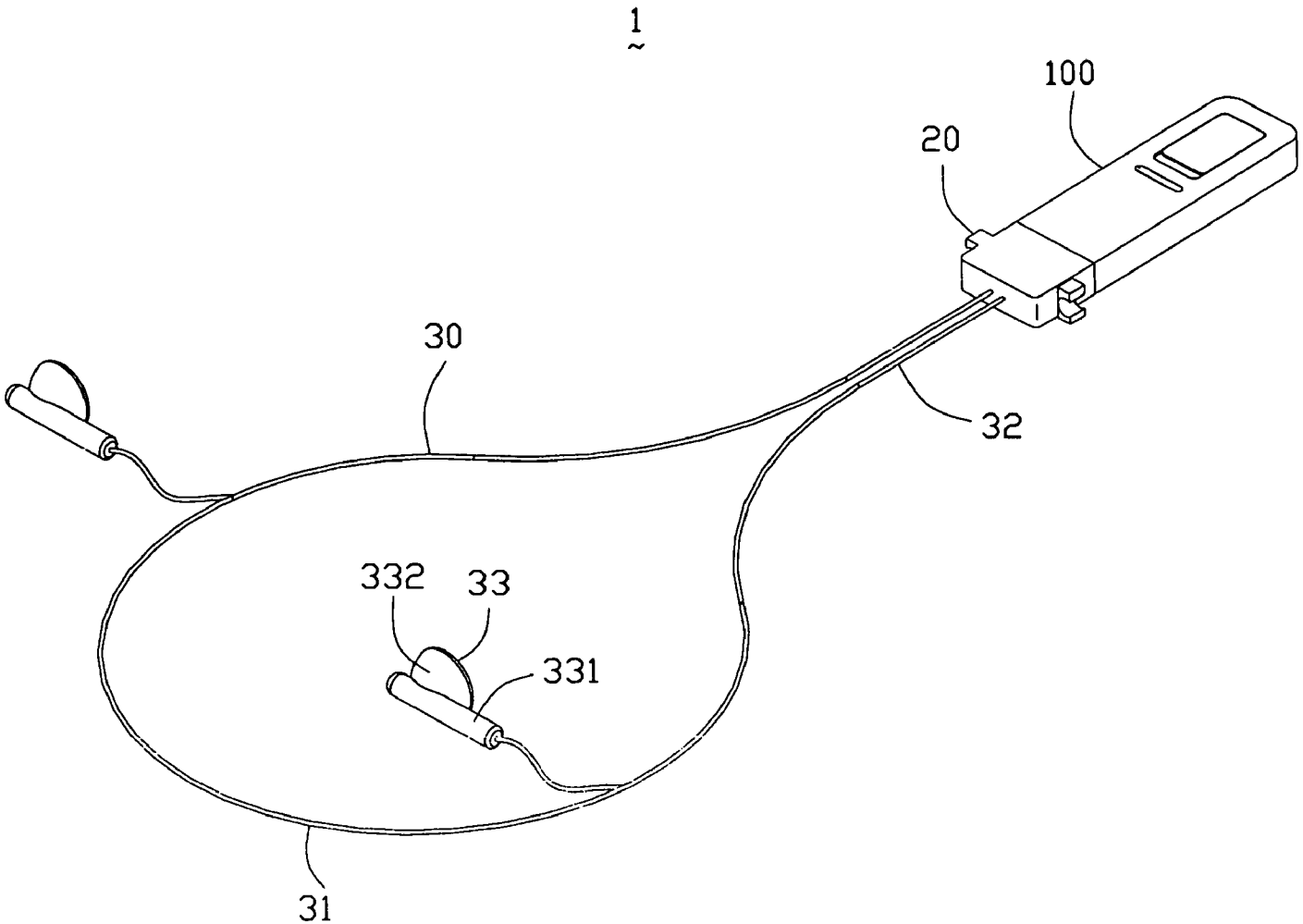
FIG. 1 is a perspective view of an electrical connector assembly in accordance with the present invention.
Figure 2:
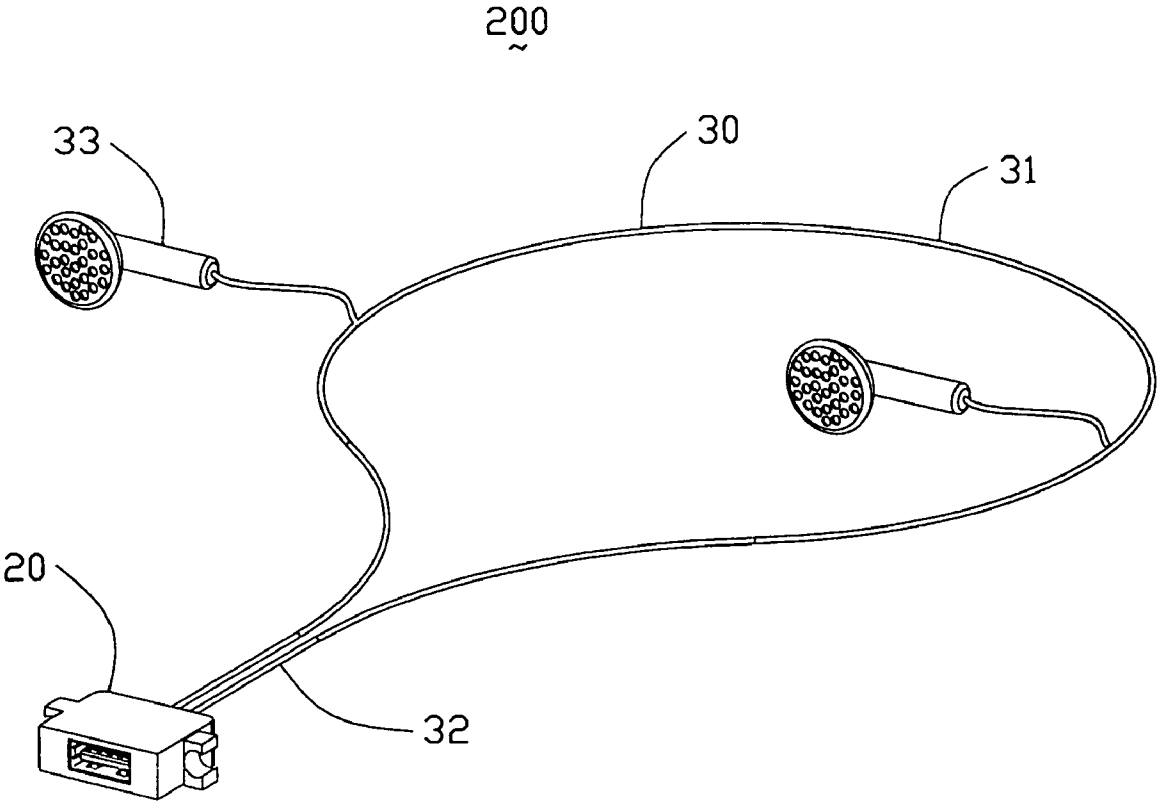
FIG. 2 is a perspective view of an audio device of the electrical connector assembly shown in FIG. 1.
Figure 3:
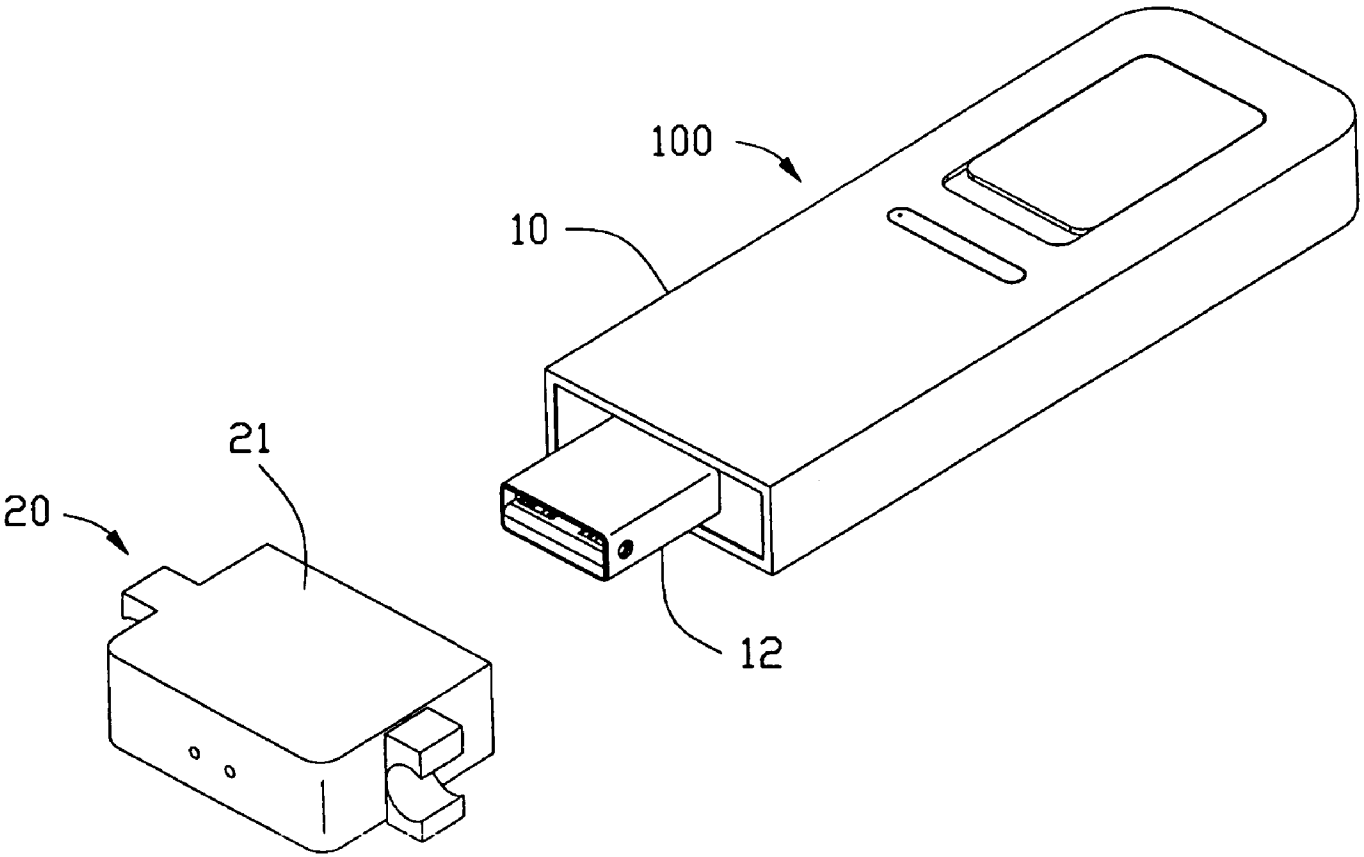
FIG. 3 is a partially exploded view of the present electrical connector assembly without earphone assembly.
Figure 4:
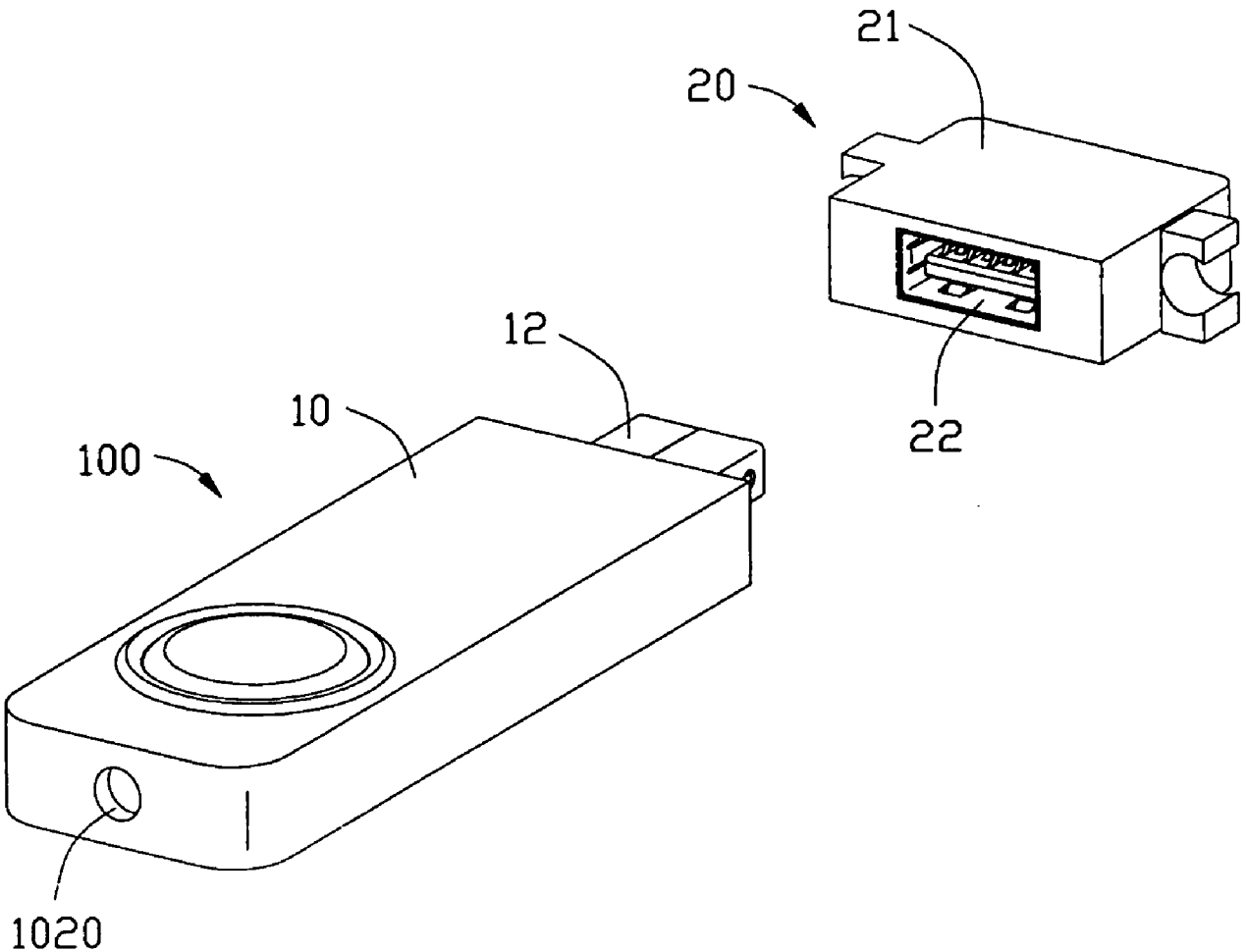
FIG. 4 is a view similar to FIG. 3, but viewed from another aspect.
Figure 5:
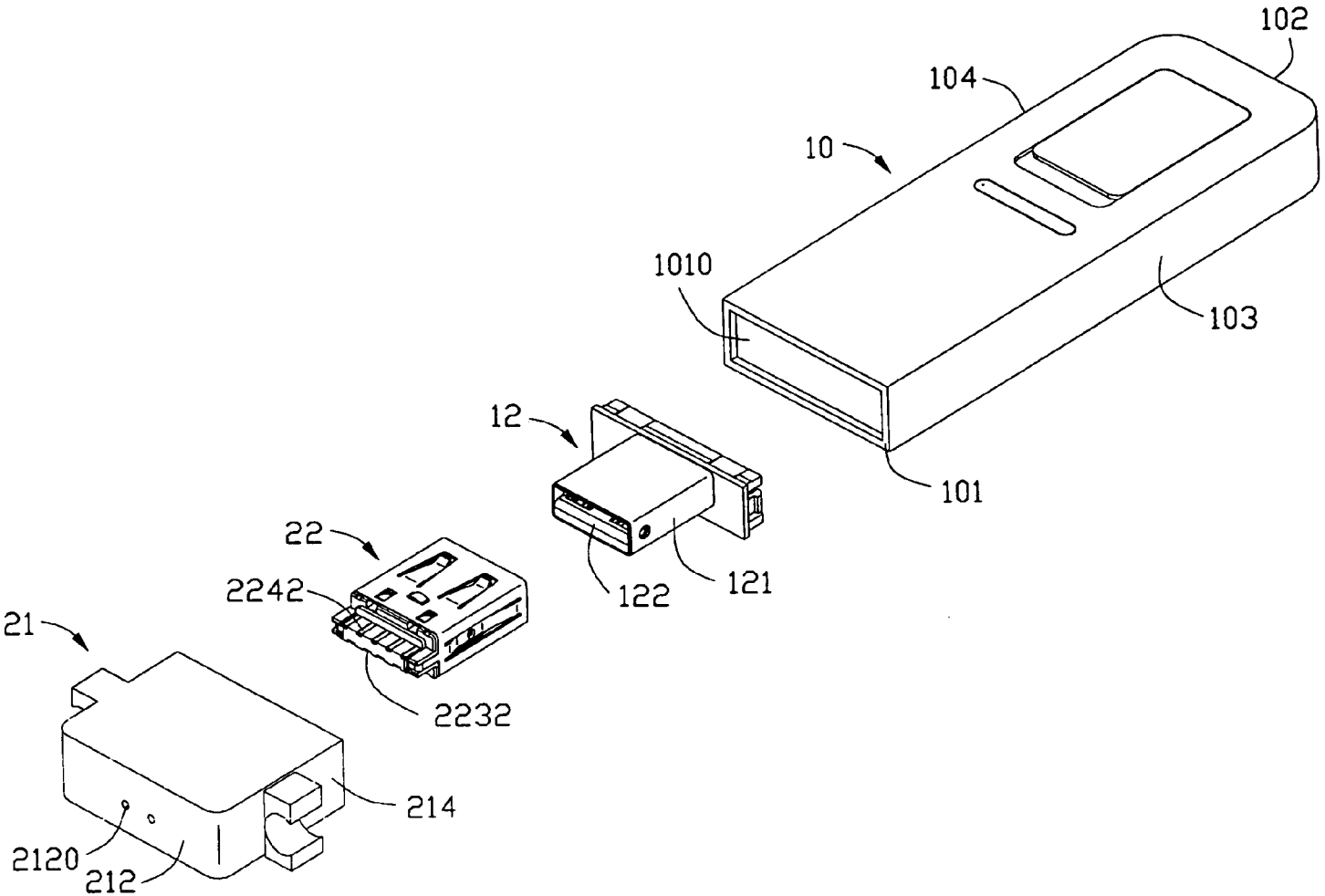
FIG. 5 is a further exploded view of FIG. 3.
Figure 6:
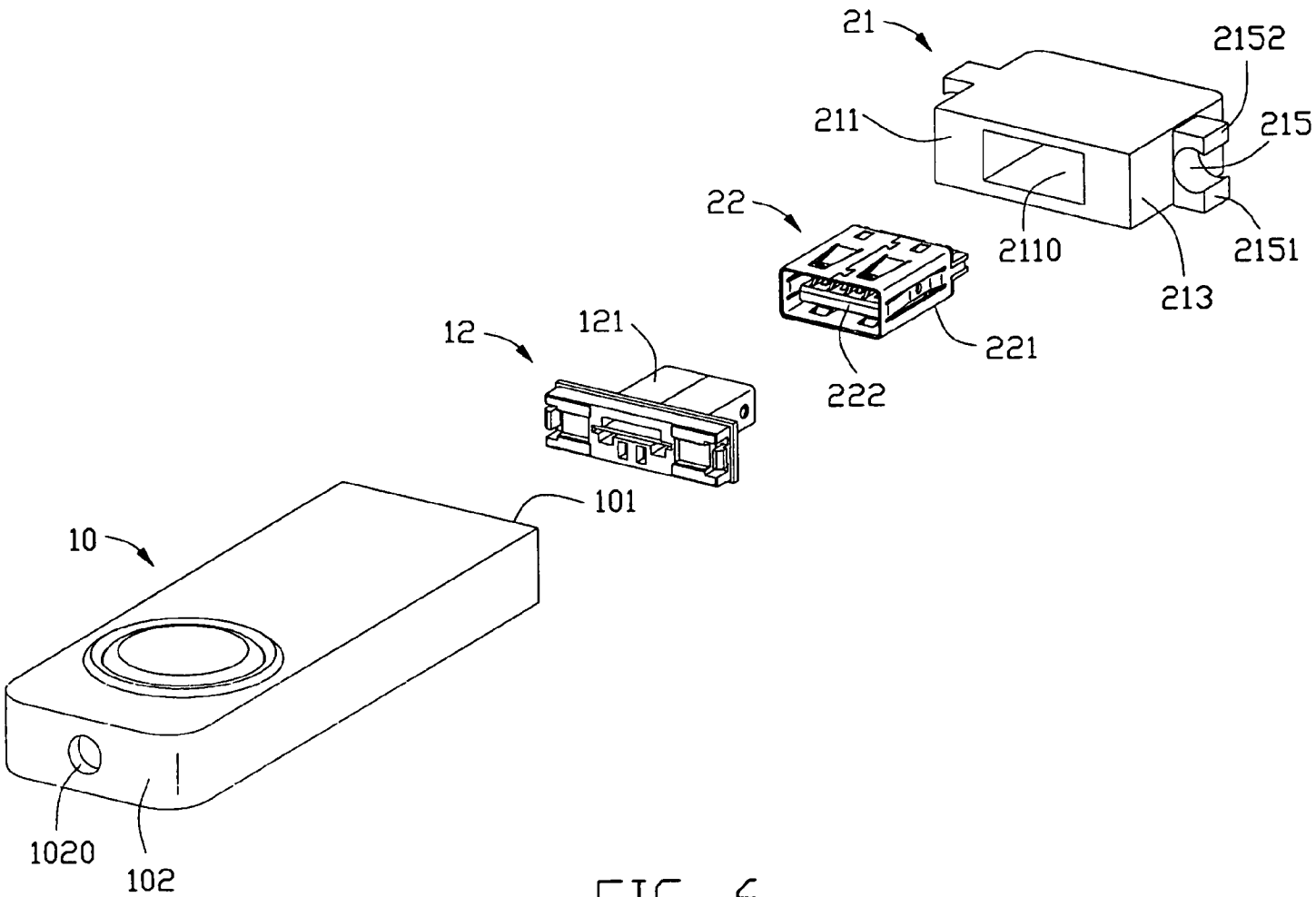
FIG. 6 is a view similar to FIG. 5, but viewed from another aspect.
Figure 7:
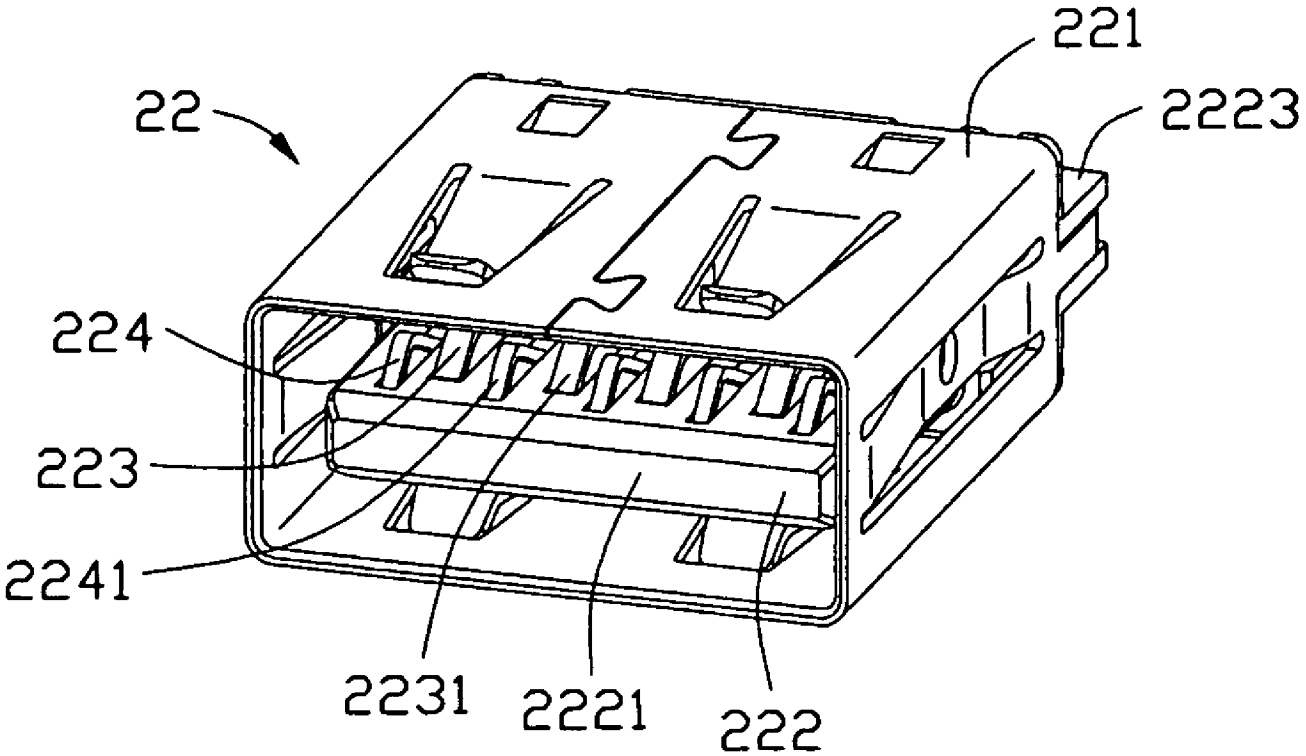
FIG. 7 is a perspective view of the first connector of the present invention.
Figure 8:
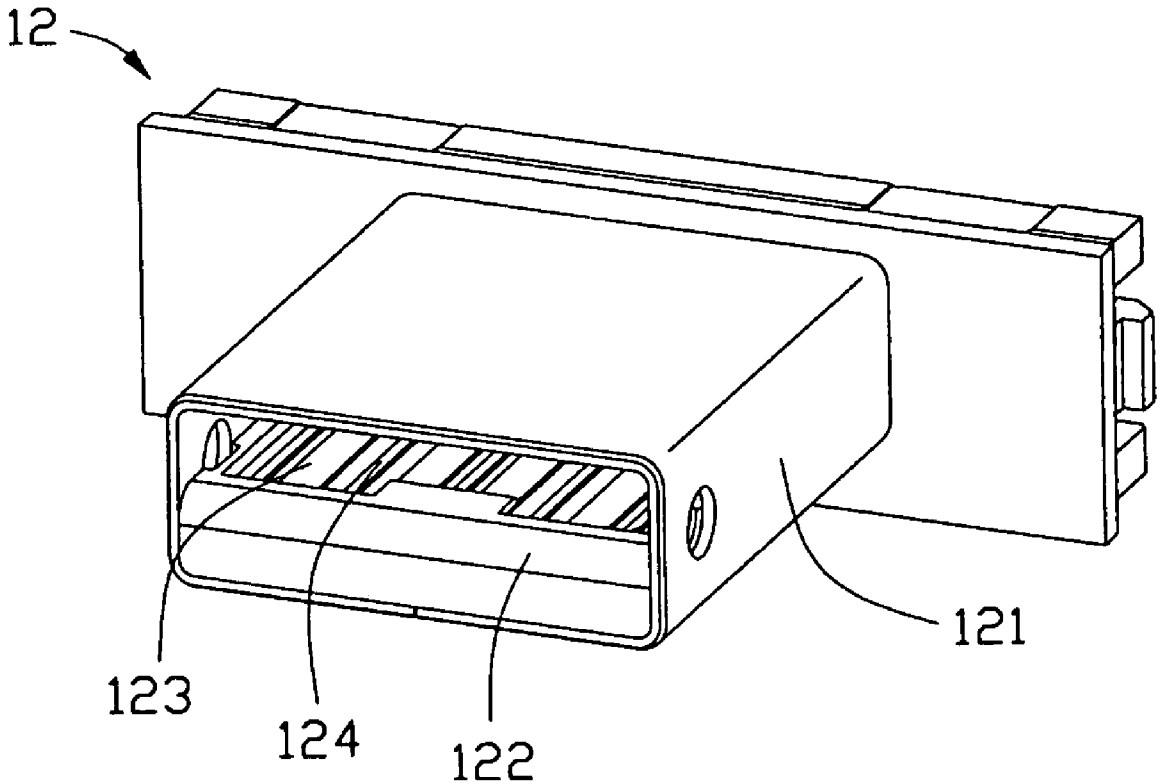
FIG. 8 is a perspective view the second connector of the present invention.

Referring to FIGS. 1-2, an electrical connector assembly 1 comprises a music player 100 and an audio output device 200 mating with the music player 100 according to the present invention. The audio output device 200 comprises a cap 20 mating with the music player 100 and an earphone assembly 30 connecting to the cap 20.

Referring to FIGS. 3-6, and 8, the music player 100 comprises a main body 10, with a first connector 12 mounted on one end of the main body 10 and a traditional audio jack 1020 on the other end of main body 10. The main body 10 is elongated, and provides a front wall 101 and a rear wall 102. The front wall 101 defines a cavity 1010 being capable of receiving the first connector 12, and the rear wall 102 defines a hole for the audio jack 1020 being accessible and capable of mating with the plug of current earphone. The first connector 12 comprises a first housing 122, a conductive element received in the first housing 122, and a first shielding member 121 enclosing the first housing 122. In the preferred embodiment, the conductive element is a PCB (Print Circuit Board), and this PCB forms four first conducting pads 123 and five second conducting pads 124 on the same end thereof and a plurality of third conducting pads on the other end for electrically connecting with components of the music player 100. The arrangement and intervals of the first conducting pads 123 are according with the standards of the USB. The first conducting pads 123 realize the function of data-transmitting between the traditional music player and computer. Three of the second conducting pads 124 are used to transmitting the audio signal, respectively corresponding to be the left track terminal, right track terminal and the grounding terminal. The conducting pads 123, 124 are arranged alternatively on the PCB so as to form an integrated port which is capable of matching with the present Female USB port. Certainly, the conductive member is not limited by the print circuit board. In alternative embodiment, it can be achieved by the method of disposing a plurality of terminals on the tongue of the housing.

The music player 100 further comprises other modules and connecting members according to the present MP 3 player, and there is no need to make a description about them.

Referring to FIGS. 3-6 and 7, the cap 20 comprises a main body 21 and a second connector 22 received in the main body 21. In the present embodiment the main body 21 is integrally insert-molded, and in other embodiment the main body 21 may consist of an upper lid and a lower lid. The main body 21 is rectangular shaped, and defines a front wall 211, a rear wall 212 opposite to the front wall 211 and two side walls 213, 214. The front wall 211 of the cap 21 has a receiving cavity 2110 to receive the second connector 22, whereas the rear wall 212 defines a pair of through holes 2120 communicating with the receiving cavity 2110. Each of the side walls 213, 214 defines a pair of projections 2151, 2152 disposed opposite to each other along the vertical direction. The inside of the projections 2151, 2152 are respectively characterized as arc shaped, and the two projections 2151, 2152 together form an arc retention groove 215 opening toward outside. The second connector 22 comprises a second housing 222, four third terminals 223 and five fourth terminals 224 respectively assembled to the second housing 222, and a second shielding member 221 enclosing the second housing 222. The third terminals 223 are according with the standards of the USB with respect to the arrangement and the interval, and each comprises a contacting portion 2231 and a tail portion 2232. Each of the fourth terminal 224 comprises a contacting portion 2241 and a tail portion 2242, and three of the fourth terminals 224 are utilized to realize the function of transmitting the audio signal corresponding to the left track terminal, the right track terminal and the grounding terminal. In the present embodiment, the other two fourth terminals 224 are left free for any use. The second housing 222 comprises a tongue board 2221 and a rear portion 2223, and the tongue board 2221 defines a plurality of receiving passageways (not labeled) arranged in a row side by side. The third and fourth terminals 223, 224 are received in the receiving passageways at intervals. The rear portion 2223 defines an upper row of slots and a lower row of slots respectively receiving the tail portions 2232 of the third terminals 223 and the tail portions 2242 of the fourth terminals 224. In preferred embodiment, the four third terminals 223 do not provide the function of electrical signal transmitting, but the contacting portions 2231 of the third terminals 223 can strengthen the reliability when mating with the first connector 12.

Referring to FIGS. 1-2, the earphone assembly 30 comprises a hanging cord 31, two headphones 33 and two strings 32 connecting with the headphones 33 and the second connector 22. The two strings 32 keep close to the hanging cord 31 or go through the hanging cord 31. One end of each string 32 connects to corresponding headphone 33 and the other end of the string 32 protrudes through corresponding through hole 2120 to be soldered with corresponding tail portion 2242 of the three audio terminals 224 of the second connector 22. Each headphone 33 comprises a rod 331 and a headphone unit 332 mounted on the rod 331.

In process of using, the cap 20 mates with the music player 100, that is the first connector 12 mates with the second connector 22. In the meanwhile, the second terminals 124 contact with corresponding fourth terminals 224. The hanging cord 31 can be hung on neck of user. Two persons can share the music by the traditional audio jack 1020 plus the cap 20 shown in the present invention. The rods 331 of the headphones 33 are received in corresponding retention grooves 215 in order to prevent the headphones 33 from swinging when the music player 100 is not in use.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An audio output device adapted for matching with a MP 3 player, comprising:

a cap having a main body and a connector received in the main body, said connector comprising a housing, a plurality of terminals receiving in said housing and a shielding member enclosing the housing;

an earphone assembly connecting with said cap;

wherein said connector is capable of matching with a plug according with the standard of USB (Universal Serial Bus), said terminals comprise three audio terminals transmitting audio signal, said earphone assembly comprises two strings connecting with said three audio terminals and a pair of headphones setting on the other end of the sirings; and wherein the main body is integrally inert-molded and of rectangular shape, comprises a front wall, a rear wall opposite to the front wall and two side walls, the rear wall of the cap defines a pair of through holes and said strings pass through the through holes and are soldered with the audio terminals;

wherein each side wall of the cap defines a pair of projections disposed opposite to each other and together form a retention groove, and wherein said headphone comprises a rod received in the retention groove and a headphone unit mounted on the rod.

2. The audio output device as claimed in claim 1, wherein the three audio terminals' respectively realize the function of transmitting the audio signal of the left track, the right track and the grounding signal.

3. The audio output device as claimed in claim 1, wherein the inner sides of the projections are characterized as are shaped.

4. The audio output device as claimed in claim 1, wherein said earphone assembly further comprises a hanging cord, and said two strings keep close to the hanging cord or go through the hanging cord.

5. The audio output device as claimed in claim 1, wherein the terminals comprise four terminals according with the standards of the USB and five terminals alternatively arranged with said four terminals, said five terminals have three audio tenninals.

6. The audio output device as claimed in claim 5, wherein each of the four terminals and five terminals respectively comprises a contacting portion and a tail portion.

7. The audio output device as claimed in claim 6, wherein the rear portion of the housing defines an upper row of receiving passageways and a lower row of slots respectively receiving the tail portions of the four terminals and the tail portions of the five terminals.

8. An electronic device assembly comprising:

an MP3 play defining a mating port with a mechanical configuration similar to a regular USB mating port;

a cap including an electrical connector mated with said mating port and defining at least three audio terminals thereof;

an earphone assembly including at least one headphone unit electrically connected to at least one of said at least three audio terminals via at least one wire; and wherein said cap further includes a holding device retaining said headphone unitin position when said headohone unit is not in use side wall of the cap a pair of projections disposed opposite to each other and together form a retention groove, and wherein said headphone comprises a rod received in the retention groove and a headphone unit mounted on the rod; and wherein said MP3 player defines an audio jack output port so as to allow a couple to share the same MP3 by transmitting audio signals from said audio jack output port and said mating port, respectively.

9. An audio output device, comprising:

a cap having a main body and a connector received in the main body, said connector comprising a housing and a plurality of terminals receiving in said housing, said terminals comprising four terminals according with the standards of the USB and five terminals alternatively arranged with said four tenrinals, said five terminals comprising three audio terminals transmitting audio signal;

an earphone assembly connecting with said cap, and comprising two strings connecting with said three audio terminals and a pair of headphones setting on the other end of the strings, and comprises a front wall, a rear wall opposite to the front wall and two side walls, each side wall of the cap defines a pair of projections disposed opposite to each other and together form a retention groove, and wherein said headphone comprises a rod received in the retention groove and a headphone unit mounted on the rod.

10. The audio output device as claimed in claim 9, wherein said earphone assembly further comprises a hanging cord, and said two strings keep close to the hanging cord or go through the hanging cord.

11. The audio output device as claimed in claim 9, wherein the inner sides of the projections are characterized as are shaped.

12. The audio output device as claimed in claim 9, wherein each of the four terminals and five terminals respectively comprises a contacting portion and a tail portion.

13. The, audio output device as claimed in claim 12, wherein the rear portion of the housing defines an upper row of receiving passageways and a lower row of slots respectively receiving the tail portions of the four terminals and the tail portions of the five terminals.

* * * * *